US006368989B1

(12) United States Patent
Pascual et al.

(10) Patent No.: US 6,368,989 B1
(45) Date of Patent: Apr. 9, 2002

(54) PUNCTURE RESISTANT COMPOSITE

(75) Inventors: Xuaco Pascual; Constantine William Tsimpris, both of Midlothian; Marvin Frank Schaffer, Richmond, all of VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/229,026

(22) Filed: Jan. 12, 1999

(51) Int. Cl.[7] ..... B32B 3/06; B32B 5/26

(52) U.S. Cl. ..... 442/254; 442/13; 442/134; 442/135; 442/246; 428/911; 36/44; 36/30 R

(58) Field of Search ..... 442/254, 13, 135, 442/246, 134; 428/911; 36/44, 30 R

(56) References Cited

U.S. PATENT DOCUMENTS

| | | | | |
|---|---|---|---|---|
| 4,916,000 A | | 4/1990 | Li et al. | 428/105 |
| 5,160,776 A | | 11/1992 | Li et al. | 428/109 |
| 5,185,195 A | | 2/1993 | Harpell et al. | 428/102 |
| 5,338,600 A | | 8/1994 | Fitchmun et al. | 428/213 |
| 5,578,358 A | | 11/1996 | Foy et al. | 428/104 |
| 5,789,699 A | | 8/1998 | Stewart et al. | 102/521 |
| 5,996,255 A | * | 12/1999 | Ventura | 36/44 |

FOREIGN PATENT DOCUMENTS

| | | | |
|---|---|---|---|
| FR | 2572260 | 5/1986 | A43B/7/32 |
| GB | 2 304 350 | 3/1997 | F41H/5/04 |
| WO | WO 96/26655 | 9/1996 | A43B/7/32 |
| WO | WO 97/04675 | 2/1997 | A43B/7/32 |
| WO | 97/43919 | 11/1997 | A43B/7/32 |
| WO | 99/13744 | 3/1999 | A43B/13/38 |
| WO | 99/21450 | 5/1999 | A43B/7/32 |

* cited by examiner

*Primary Examiner*—Terrel Morris
*Assistant Examiner*—John J. Guarriello

(57) ABSTRACT

A puncture resistant footwear sole composite is disclosed with a plurality of layers of woven aramid yarn fabric combined with a matrix resin in an amount adequate to adhere adjacent fabric layers together but not so much that the composite is saturated by matrix resin.

11 Claims, No Drawings

PUNCTURE RESISTANT COMPOSITE

BACKGROUND OF THE INVENTION

1. Field of the Invention

This invention relates to puncture resistant structures and includes woven layers of high performance yarns combined with a nonsaturating level of flexible polymeric matrix resins.

2. Discussion of the Prior Art

French Certificate of Utility No. 2,572,260, published Jul. 24, 1987 teaches, very generally, that layers of aramid fabric can be placed in the sole of footwear to protect against injury which might result from stepping on sharp objects.

International Publication WO 97/04675, published Feb. 13, 1997 teaches a boot sole with at least 10 layers of aramid fabric having an areal density of less than 4 ounces/square yard (136 g/m$^2$) for protection from explosive blasts.

International Publication WO 96/26655, published Sep. 6, 1996 teaches a boot sole with at least one layer of aramid fabric having an areal density of more than 15 ounces/square yard (509 g/m$^2$) for protection from explosive blasts.

U.S. Pat. No. 5,185,195, issued Feb. 9, 1993 on the application of G. A. Harpell et al, teaches a puncture resistant construction using at least two layers of fabric made from a variety of high performance fibers.

U.S. Pat. No. 5,578,358, issued Nov. 26, 1996 on the application of B. E. Foy et al, teaches a fabric-only, penetration resistant, article of apparel.

SUMMARY OF THE INVENTION

This invention relates to a puncture resistant composite and especially a puncture resistant footwear sole component comprising a plurality of layers of woven aramid yarn and a matrix resin combined with the layers of woven yarn to hold adjacent layers together and to limit relative movement of individual yarns in each layer, wherein the layers of aramid yarn are woven to a tightness factor of 0.9 to 1.0 and the matrix resin is present in an amount of from 4 to 30 weight percent of the total weight of the layers and the matrix resin.

The matrix resin is present in an amount which holds the yarns in place but does not completely fill voids among the yarns or voids among fibers in the yarns.

DETAILED DESCRIPTION

Footwear which is impervious to puncture from beneath by nails and thorns and the like, is very important in varied fields such as construction and forestry. This invention relates to a puncture resistant composite for use as a footwear sole component and includes a plurality of specified layers of woven aramid yarn in a particular combination with a matrix resin.

By "aramid" is meant a polyamide wherein at least 85% of the amide (—CO—NH—) linkages are attached directly to two aromatic rings. Suitable aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511.

Additives can be used with the aramid and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride or the aramid.

Para-aramids are the primary polymers in fibers of this invention and poly (p-phenylene terephthalamide)(PPD-T) is the preferred para-aramid. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which permit preparation of anisotropic spin dopes. Preparation of PPD-T is described in U.S. Pat. Nos. 3,869,429; 4,308,374; and 4,698,414.

The yarns used in this invention must have a high tenacity combined with a high elongation to break to yield a high toughness. The tenacity should be at least 19 grams per dtex (21.1 grams per denier) and there is no known upper limit for tenacity. Below about 11.1 grams per dtex, the yarn doesn't exhibit adequate strength for meaningful protection. The elongation to break should be at least 3.0 percent and there is no known upper limits for elongation. Elongation to break which is less than 3.0 percent results in a yarn which is brittle and yields a toughness which is less than necessary for the protection sought herein. "Toughness" is a measure of the energy absorbing capability of a yarn up to its point of failure in tensile stress/strain testing. Toughness is sometimes, also, known as "Energy to Break". Toughness or Energy to Break is a combination of tenacity and elongation to break and is represented by the area under the stress/strain curve from zero strain to break. A yarn toughness of at least 35 Joules/gram is believed to be necessary for adequate penetration resistance in practice of this invention; and a toughness of at least 38 Joules/gram is preferred.

High performance yarns are available in a wide variety of linear densities and it has been determined by the inventors herein that acceptable penetration resistance, for purposes of this invention, can be obtained over a wide range of linear densities. Aramid yarns of greater than about 1000 dtex, even when woven to a fabric tightness factor of nearly 1.0, are believed to yield between the adjacent yarns and permit easier penetration of a sharp instrument. The improvement in penetration resistance of this invention can be expected to continue to very low linear densities; but, at about 100 dtex, the yarns begin to become very difficult to weave without damage. With that in mind, the aramid yarns of this invention have a linear density of from 100 to 1000 dtex.

While some protection is provided by a single layer of the woven aramid yarn and matrix resin of this invention, it has been determined that a single layer does not provide protection which is adequate for most needs or which will pass the usually-used penetration tests for footwear. It has been found that adequate protection is obtained using at least two layers of the material; and that more than about fourteen layers are unnecessary. When more than about fourteen layers are used, the composite becomes too thick and stiff for comfortable use as well as difficult to use in footwear manufacture.

The fabric layers are woven using para-aramid yarns with a linear density of 100 to 1000 dtex. Plain weave is preferred at a fabric tightness factor of greater than about 0.90, although other weave types, such as basket weave, satin weave, or twill weave, can be used.

In the event that fabrics are used having weaves which are more open than a plain weave, there is a need for more matrix resin to hold the yarns in place. For that reason, plain weave fabrics and fabrics with close weaves are preferred.

A wide variety of polymers can be used as the matrix resin of this invention. The matrix resin is preferably a thermoplastic polymer with melt properties which limit penetration of the resin into the fabric layers during processing under heat and pressure.

The matrix resin should adhere to the fabric layers and prevent lateral movement of the yarns, while still permitting flex in the composite after molding. Eligible matrix resins include polyethylene, ethylene copolymers, polyesters, polyurethane, thermoplastic elastomers, silicone elastomers, plasticized polyvinylchloride, ionomers, neoprene and other rubber compounds. Polyethylene is preferred.

The matrix resin is usually used in the form of a film material of thickness from 6.5 to 100 micrometers (0.25 to 4 mils). The film thickness is chosen based on the amount of matrix resin desired in the composite. The composite is usually made by subjecting alternating layers of fabric and matrix resin film under heat and pressure. Although not preferred, the matrix resin can be applied to fabric layers by coating the layers with a solution or a melt of the matrix resin or by other means for applying the matrix resin; although care must be exercised to ensure that an unacceptable, saturating, excess of matrix resin is not used.

The matrix resin in the composite of this invention serves the two-fold purpose of: (i) holding yarns in a fabric to restrain, but not entirely prevent, lateral relative yarn movement and (ii) adhering adjacent fabric layers together to prevent relative layer movement. It has been determined that the composite of this invention should have from about 4 to about 30 weight percent matrix resin.

Matrix resin at a level of less than 4 weight percent has been found to provide inadequate stability for the yarns and inadequate layer-to-layer adhesion. It is desirable, however, to use as little matrix resin as will provide acceptable penetration resistance results because, in general, composite flexibility is reduced as matrix resin is increased. Penetration resistance increases with increase in matrix resin up to a concentration of about 27 weight percent and then falls off. At a matrix resin concentration of greater than about 30 weight percent, penetration resistance is acceptable but the composites are unacceptably stiff due to a saturation of the fabric by the matrix resin. Such saturation is to be avoided.

Studies have shown that a preferred balance of penetration resistance and stiffness is obtained in the matrix resin concentration range of about 8–14 weight percent.

It has been discovered that the composite of this invention can be constructed with a very useful stiffness directionality. Fabric layers of the composite can be arranged such that the warp yarns of adjacent fabric layers are parallel and, when adhered by the matrix resin in accordance with this invention, the composite will exhibit considerably more flexibility in the direction of the warp yarns. When a composite is desired having no stiffness directionality, the adjacent fabric layers should be arranged with nonparallel warp yarn alignment.

In the composition of this invention, when heel-to-toe flexibility is desired, the fabric layers should be assembled such that the warp yarns are parallel with the heel-to-toe axis and the fill yarns are perpendicular with the heel-to-toe axis. If heel-to-toe stiffness is desired, the fill yarns should be aligned parallel with the heel-to-toe axis and the warp yarns should be aligned perpendicular with the heel-to-toe axis.

"Fabric tightness factor" and "Cover factor" are names given to the density of the weave of a fabric. Cover factor is a calculated value relating to the geometry of the weave and indicating the percentage of the gross surface area of a fabric which is covered by yarns of the fabric. The equation used to calculate cover factor is as follows (from Weaving: Conversion of Yarns to Fabric, Lord and Mohamed, published by Merrow (1982), pages 141–143):

dw=width of warp yarn in the fabric df=width of fill yarn in the fabric pw=pitch of warp yarns (ends per unit length)

pf=pitch of fill yarns $$Cw = \frac{dw}{pw} \qquad Cf = \frac{df}{pf}$$

$$\text{Fabric Cover Factor} = C_{fab} = \frac{\text{total area obscured}}{\text{area enclosed}}$$

$$C_{fab} = \frac{(pw - dw)df + dwpf}{pwpf} = (Cf + Cw - CfCw)$$

Depending on the kind of weave of a fabric, the maximum cover factor may be quite low even though the yarns of the fabric are situated close together. For that reason, a more useful indicator of weave tightness is called the "fabric tightness factor". The fabric tightness factor is a measure of the tightness of a fabric weave compared with the maximum weave tightness as a function of the cover factor.

$$\text{Fabric tightness factor} = \frac{\text{actual cover factor}}{\text{maximum cover factor}}$$

For example, the maximum cover factor which is possible for a plain weave fabric is 0.75; and a plain weave fabric with an actual cover factor of 0.68 will, therefore, have a fabric tightness factor of 0.91.

The tightness factor for fabrics to be used in practice of this invention is at least 0.9 but no greater than 1.0. It has been learned that a tightness factor of at least 0.9 is necessary to avoid penetration of the composite by sideways movement of the fabric yarns. It has, also, been learned that fabrics with tightness factors of greater than 1.0 exhibit reduced penetration resistance for a given weight of fabric. This result was unexpected and is not entirely understood by the inventors.

The areal density of the composite of this invention is from 0.48 to 2.94 kilograms per square meter (0.1 to 0.6 pounds per square foot) and the thickness is from 0.25 to 2.03 millimeters (0.01 to 0.08 inch).

TEST METHODS

Composites of this invention are tested for penetration resistance by means of a nail mounted in an Instron device and pressed into the composite which is mounted to simulate a footwear construction.

The nail is made from metal having a hardness of at least 60 HRC with a shank diameter of 4.5±0.05 mm tapering the end at an included angle of 30° to a truncated point of 1.0±0.02 mm diameter. The shank extends 40 mm vertically from a pressure arm of the testing machine. The nail extends to and through a fixed base plate at the center of a 25 mm diameter hole.

The composite to be tested is placed on the fixed base plate and the nail is driven against the composite at a uniform rate of 10 mm/minute until the nail penetrates the composite. The force required to drive the nail is recorded and the maximum force is taken as the penetration force for the purpose of this test. The composite is said to "pass" the test if the penetration force is greater than 1100 Newtons (250 pounds). Each test is conducted at least four times on each composite sample and each test penetration is located at least 30 mm from all other penetrations.

This test is similar to a test used in the European footwear industry and known as EN-344.

The composite is the construction of this invention and may be accompanied by a footwear outsole on one side and, on occasion, a footwear insole on the other side. As a matter of fact, the composite can be placed anywhere in the sole of the footwear. For example, between the outsole and the midsole, or between the midsole and the insole, or even on top of the insole. The composite can also function as an insole itself. When used as an insole, the composite can be either attached to the midsole or left unattached and removable from the shoe. If desired, a cover fabric can be added to the composite for aesthetic reasons or to increase durability. When attached to the insole, midsole, or outsole, or any combination of these, the composite can be attached by gluing, stitching or compounding.

EXAMPLES

For the following examples, composites of this invention were made from several fabrics for penetration testing. In each case, the fabrics were constructed in plain weave using para-aramid yarns of a variety of linear densities; and, in all cases, a matrix resin was used in combination with the fabrics.

The composites were as follows:

| Item | Yarn Count (per cm) | Yarn Wt. (dtex) | Fabric Wt. ($g/m^2$) | Cover/Tightness (%)/(%) |
|---|---|---|---|---|
| 1 | 28 × 28 | 220 | 122 | 75/100 |
| 2 | 12 × 12 | 440 | 108 | 53/71 |
| 3 | 14 × 14 | 440 | 122 | 59/79 |
| 4 | 12 × 12 | 930 | 220 | 70/93 |
| 5* | 43 × 26 | 220/440 | 250 | >75/~120 |

*This is a very tightly-woven para-aramid fabric sold by Warwick Mills under the tradename "Turtleskin".

Example 1

This example illustrates the puncture resistance of composites of this invention using the composites identified as Items 1 through 4, above. All composites were tested in accordance with EN-344—the test method set out above. The test composite was placed between, but not attached to, an outsole material and a midsole material. Puncture of the materials was achieved by first penetrating the outsole, then the test composite, and finally the midsole.

The test composite consisted of alternating layers of fabric and resin. Individual layers of fabric and resin film were laid up and fused together using a press operating at a temperature of 149° C. (300° F.) and a pressure of 1030 kPa (150 psi) for 20 minutes. The composites had a 9 weight percent matrix resin content and the resin was linear low density polyethylene (LLDPE) film. Four, 8, and 12 layers of each fabric where used to make separate composites.

The outsole was a black nitrile rubber-based compound containing aramid short fiber reinforcement commonly used for high performance worksoles. The midsole was a black nitrile rubber-based compound commonly used in stitched constructions and high performance footwear. Tests showed that the penetration force for the outsole and the midsole without the composite was 355 Newtons.

| Item | Areal Density ($kg/m^2$) | Number of Layers | Penetration Force (Newtons) |
|---|---|---|---|
| 1 | 0.59 | 4 | 868 |
| 1 | 1.1 | 8 | 1160 |
| 1 | 1.8 | 12 | 2350 |
| 2 | 0.49 | 4 | 565 |
| 2 | 0.98 | 8 | 881 |
| 2 | 1.5 | 12 | 1170 |
| 3 | 0.54 | 4 | 712 |
| 3 | 1.1 | 8 | 1050 |
| 3 | 1.6 | 12 | 1480 |
| 4 | 1.0 | 4 | 690 |
| 4 | 2.1 | 8 | 1660 |
| 4 | 3.1 | 12 | 3200 |

Example 2

This example illustrates the effect of matrix resin concentration and bonding pressure on composites of this invention using the fabric of Item 1 and LLDPE as the matrix resin. Composites were made and tested as in Example 1 using the same outsole/midsole combination as in Example 1.

Example 2A

This example illustrates the need for a specific matrix resin concentration for these composites and further illustrates there is a penetration maximum for these composites near 27 weight percent matrix resin. All of these composites were bonded using the same conditions as were used in Example 1.

| Number of Layers | Resin Content (%) | Penetration Force (Newtons) |
|---|---|---|
| 4 | 4.5 | 841* |
| 4 | 9 | 912 |
| 4 | 16 | 948 |
| 4 | 27 | 908 |
| 4 | 44 | 912** |
| 8 | 4.5 | 1510* |
| 8 | 9.0 | 1670 |
| 8 | 16 | 1770 |
| 8 | 27 | 1870 |
| 8 | 44 | 1750** |
| 12 | 4.5 | 2300* |
| 12 | 9.0 | 2380 |
| 12 | 16 | 2710 |
| 12 | 27 | 2860 |
| 12 | 44 | 2510** |

*Indicates that full probe penetration of composite was not possible due to flexible material being pushed through the midsole before penetration could occur.
**Excessively stiff material.

Example 2B

This example illustrates the affect of bonding pressure on the penetration resistance of the composite. The temperature and time of bonding were the same as were used in Example 1.

| Number of Layers | Resin Content (%) | Penetration Force (Newtons) | Bonding Pressure (kpa) |
|---|---|---|---|
| 4 | 4.5 | 792 | 170 |
| 4 | 4.5 | 841 | 1030 |
| 4 | 9 | 846 | 170 |
| 4 | 9 | 912 | 1030 |
| 4 | 16 | 868 | 170 |
| 4 | 16 | 948 | 1030 |
| 4 | 27 | 979 | 170 |
| 4 | 27 | 908 | 1030 |
| 4 | 44 | N/A* | 170 |
| 4 | 44 | 912 | 1030 |
| 8 | 4.5 | 1250 | 170 |
| 8 | 4.5 | 1510 | 1030 |
| 8 | 9 | 1420 | 170 |
| 8 | 9 | 1670 | 1030 |
| 8 | 16 | 1480 | 170 |
| 8 | 16 | 1770 | 1030 |
| 8 | 27 | 1750 | 170 |
| 8 | 27 | 1870 | 1030 |
| 8 | 44 | N/A* | 170 |
| 8 | 44 | 1750 | 1030 |
| 12 | 4.5 | 1920 | 170 |
| 12 | 4.5 | 2300 | 1030 |
| 12 | 9 | 1980 | 170 |
| 12 | 9 | 2380 | 1030 |
| 12 | 16 | 2120 | 170 |
| 12 | 16 | 2710 | 1030 |
| 12 | 27 | 2410 | 170 |
| 12 | 27 | 2860 | 1030 |
| 12 | 44 | N/A* | 170 |
| 12 | 44 | 2510 | 1030 |

*Pressure was not sufficient to bond a stable composite.

Example 3

Composites were made using the Item 1 fabric, LLDPE as the matrix resin in the same concentration as was used in Example 1, and the same conditions as were used in Example 1. The composites were tested under the same conditions as before, but with a different outsole. The outsole, for this example, was a black nitrile rubber-based compound with no aramid short fiber reinforcement. No difference was found in the penetration force of the composites.

Example 4

Composites were made using the same fabric and matrix resin as were used in Example 3 and they were tested under the same conditions as before, however, the location of the composite in relation to the outsole and midsole was varied. A composite was sandwiched between the outsole and the midsole and tested as in Example #1, and this was compared with the same type of composite placed above the midsole, that is, the penetration was first through the outsole, then the midsole, and then the composite. The penetration forces for these composites were substantially the same as those found in the tests of Example 3. This was repeated with 27% LLDPE resin instead of 9%, with substantially the same results as were obtained in Example 2A for 27% matrix resin.

Example 5

Composites were made using the same fabric and matrix resin as was used in Example 3 and they were tested under the same conditions as before, however, in one test the composite was not attached to the outsole/midsole combination as in Example 1 while in the other test the composite was adhered to both the midsole and outsole. The composite was adhered to the outsole and midsole using an adhesive sealant sold for use in repairing footwear commercially available under the tradename "SHOE GOO" sold by Eclectic Products, Inc., Pineville, La. The penetration forces for these composites were substantially the same as those found in the tests of Example 3. This was repeated with 27% LLDPE resin instead of 9% with substantially the same results as were obtained in Example 2A for 27% matrix resin.

Example 6

This is a comparison between composites made with a fabric having a fabric tightness greater than 1.0 and one having a tightness within the range of this invention. The matrix resin was LLDPE at a concentration of 9 weight percent, and the composites were made and tested as in Example 1. The penetration force for the control (midsole and outsole without the composite) was 360 Newtons. Note that the composites made using a fabric of tightness greater than 1.0 required nearly twice as much fabric as was required for composites made using a fabric having a tightness within the scope of this invention, for a given penetration force.

| Item No. | Number of Layers | Areal Density ($Kg/m^2$) | Penetration Load (Newtons) |
|---|---|---|---|
| 1 | 4 | 0.54 | 1100 |
| 5 | 4 | 1.1 | 1070 |
| 1 | 8 | 1.1 | 1660 |
| 5 | 8 | 2.1 | 1910 |
| 1 | 12 | 1.6 | 2450 |
| 5 | 12 | 3.2 | 2740 |

What is claimed is:

1. A puncture resistant footwear sole component comprising:

a plurality of layers of woven aramid yarn;

a matrix resin combined with the layers to hold adjacent layers together and to limit relative movement of individual yarns in each layer, wherein the layers of aramid yarn are woven to a tightness factor of 0.9 to 1.0 and the matrix resin is present in an amount of from 4 to 30 weight percent of the total weight of the layers and the matrix resin.

2. The sole component of claim 1 wherein the aramid is poly(p-phenylene terephthalamide).

3. The sole component of claim 2 wherein the yarn has a linear density of 100 to 1000 dtex.

4. The sole component of claim 1 wherein the woven layers are plain weave.

5. The sole component of claim 1 wherein there are from 4 to 14 layers of woven aramid yarn.

6. The sole component of claim 1 wherein the matrix resin is polyethylene.

7. The sole component of claim 1 wherein the matrix resin is uniformly distributed throughout the layers of aramid yarn.

8. The sole component of claim 1 wherein the matrix resin is located between the layers of woven aramid yarn and wherein the matrix resin is adhered to yarns of the layers to prevent relative layer movement.

9. The sole component of claim 1 wherein the layers of woven yarn and the matrix resin exhibit an areal density of 0.48 to 2.94 kilograms per square meter (0.1 to 0.6 pounds per square foot).

10. The sole component of claim 1 wherein the composite is from 0.25 to 2.0 millimeters (0.01 to 0.08 inch) thick.

11. The sole component of claim 1 wherein each layer of woven aramid yarn has warp yarns and fill yarns and the layers are aligned such that the warp yarns of adjacent layers are parallel.

* * * * *